United States Patent [19]

Holznagel

[11] Patent Number: 4,706,087

[45] Date of Patent: Nov. 10, 1987

[54] PORTABLE TRAFFIC SIGNAL

[76] Inventor: Melvin A. Holznagel, Rte. 4, Box 273A, Sherwood, Oreg. 97140

[21] Appl. No.: 694,465

[22] Filed: Jan. 24, 1985

[51] Int. Cl.[4] ..... G08G 1/095

[52] U.S. Cl. ..... 340/908; 340/119

[58] Field of Search ..... 340/908, 119, 108, 104; 248/347, 654, 281.1, 280.1; 211/195, 198, 201, 202; 182/2; 116/63 P

[56] References Cited

U.S. PATENT DOCUMENTS

| | | | |
|---|---|---|---|
| 2,941,185 | 6/1960 | Mullikin | 340/908 |
| 3,176,792 | 4/1965 | Olson | 182/2 |
| 3,543,019 | 11/1970 | Jacobsen . | |
| 3,562,705 | 2/1971 | Paris | 340/908 |
| 3,729,706 | 4/1973 | Hein | 340/908 |
| 3,995,250 | 11/1976 | Ferree | 340/908 |
| 4,032,883 | 6/1977 | Gibson | 340/908 |
| 4,150,755 | 4/1979 | Trott et al. | 414/11 |
| 4,152,854 | 5/1979 | Berry, Jr. et al. | 340/109 |
| 4,175,899 | 11/1979 | Tipton | 414/11 |
| 4,213,172 | 7/1980 | Scattolin et al. . | |
| 4,234,150 | 11/1980 | Mee et al. . | |
| 4,540,065 | 9/1985 | Kawaguchi et al. | 182/2 |
| 4,593,265 | 6/1986 | McKenney | 340/119 |
| 4,616,225 | 10/1986 | Woudenberg | 340/908 |

FOREIGN PATENT DOCUMENTS

| | | | |
|---|---|---|---|
| 583687 | 11/1945 | United Kingdom | 248/281.1 |

*Primary Examiner*—John W. Caldwell, Sr.
*Assistant Examiner*—Tyrone Queen
*Attorney, Agent, or Firm*—Dellett, Smith-Hill and Bedell

[57] ABSTRACT

A portable traffic signal has a base for mounting on the bed of a transporting vehicle, an articulated frame pivotally attached to the base and capable of extending and contracting and a traffic signal light supported by the frame such that when the frame is extended the signal light is elevated and horizontally displaced from the transporting vehicle. When the frame is fully contracted, the signal light and the frame are compactly fitted onto the base. The frame comprises structural members connected by hinge assemblies in the form of two adjacent parallelograms and two adjacent quadrangles, the quadrangles being other than parallelograms such that when the frame is fully contracted the structural members are in substantial horizontal alignment above the bed.

12 Claims, 6 Drawing Figures

PORTABLE TRAFFIC SIGNAL

BACKGROUND OF THE INVENTION

This invention relates generally to vehicular traffic signals and in particular to portable traffic signals for temporary installation on highways.

In the past, flagmen have been employed maintain traffic flow at construction sites in sections of highways being repaired. Similarly, during unusually heavy traffic conditions policemen have directed the flow of traffic at highway intersections where traffic signal lights are normally unnecessary.

Portable traffic signals have also been utilized for temporary control of traffic flow. A typical portable traffic signal light is described in U.S. Pat. No. 3,995,250 issued Nov. 30, 1976. One signal light is supported at the side of a road by a vertical member while a second signal light is supported above the road by a horizontal boom attached to the vertical member. The vertical member is supported on a base set on the ground and a vehicle is parked with a wheel resting on the base to anchor the signal light assembly. This portable signal light, while useful, requires time and manual effort to erect and dismantle and lacks stability in high winds.

What is needed is a pair of easily transported traffic signal lights capable of being erected and lowered rapidly with a minimum of manual effort. When erected, the signal lights should be stable and positioned at least eight feet above the level of the roadway and at least eight feet apart laterally so that they may be easily seen by motorists.

SUMMARY OF THE INVENTION

In one aspect of the present invention, a pair of traffic signals are mounted with each on a separate collapsible frame. The frames are mounted on a base suitable for attaching to the bed of a small truck or trailer. To install the traffic signals, the truck or trailer is parked near the side of the roadway and the traffic signal frames are extended to support the signals at least eight feet above the roadway while horizontally extending one signal light at least four feet to the left of the vehicle centerline and extending the second signal light at least four feet to the right of the vehicle centerline. After use, the frames are collapsed onto the supporting base such that the frames and signal lights may be compactly stored on the truck or trailer for easy transport without vulnerability to damage.

In another aspect of the invention, each frame comprises an articulated parallelogram formed of parallel first and fourth structural members and parallel second and third structural members and an articulated quadrangle, being other than a parallelogram, having adjacent sides defined by extensions of the first and second members such that the quadrangle and the parallelogram share a common joint. A third side of the quadrangle is defined by a fifth structural member hinged to the second member and a fourth side is defined by the base, the first and fifth members being attached to the base. All corners of the parallelogram and the quadrangle are articulated by means of hinge assemblies connecting adjacent sides. A signal light is mounted on the fourth member.

The frame is fully extended by rotating the first member about its point of attachment to the base until the first member is vertically upright. With the first member vertically positioned, the second and third members are inclined from the horizontal, and the fourth member, being parallel to the first member, is supported by the adjacent second and third members generally above and horizontally displaced from the first member, thereby positioning the attached signal light above the level of the roadway and extending the signal light from the supporting vehicle.

The frame is fully contracted by rotating the first member about its point of attachment to the base to a horizontal position. The point of attachment of the fifth member to the base is juxtaposed in relation to the point of attachment of the first member extension to the base such that when the first member is rotated to a horizontal position, the second, third and fourth members collapse into parallel relation with the the first member.

In the preferred embodiment, means to rotate the first member from a horizontal to a vertical position is provided comprising a hydraulic jack having a movable end pivotally attached to the first member and a fixed end pivotally attached to the base. The first member is rotated to the vertical position by extending the jack and rotated to the horizontal position by contracting the jack.

It is accordingly an object of the present invention to provide an improved portable traffic signal that may be quickly and easily erected and collapsed.

Another object of the present invention is to provide an improved portable traffic signal that may be easily transported in a compact configuration on the bed of a truck or a trailer.

Yet another object of the present invention is to provide improved portable traffic signals for mounting on the bed of a truck or trailer parked near a roadway, having a pair of traffic signal lights supported at least eight feet above the surface of the roadway and separated by a lateral distance of at least eight feet.

The subject matter of the present invention is particularly pointed out and distinctly claimed in the concluding portion of this specification. However, both the organization and method of operation of the invention, together with further advantages and objects thereof, may best be understood with reference to the following description taken in connection with the accompanying drawings wherein like reference characters refer to like elements.

DETAILED DESCRIPTION

Figure 1:
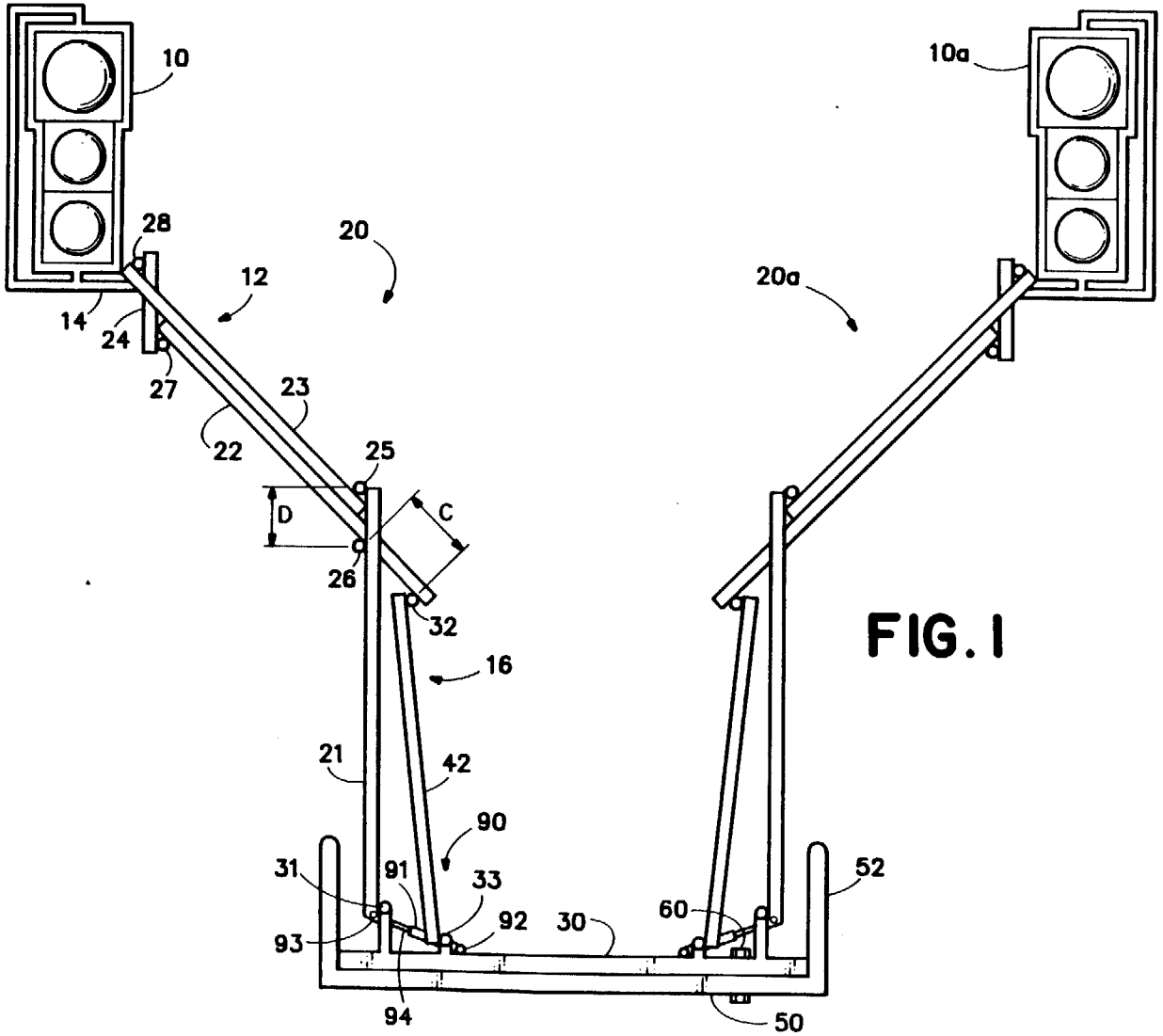
FIG. 1 is an elevation view of the present invention in fully extended position.

Referring to FIG. 1, an elevation view of a portable traffic signal according to the present invention is illustrated comprising signal light 10 supported by articulated frame 20 mounted on base 30. A second articulated frame **20*a* similarly supports signal light 10*a***.

In the preferred embodiment, base 30 is not more than 48 inches wide so that it may fit on bed 50 of a truck, a trailer or other supporting vehicle suitable for carrying loads at least 48 inches wide. Base 30 is attached to bed 50 using nut and bolt assemblies 60 or other suitable attachment means.

Frame 20, shown in FIG. 1 in a fully extended position, comprises in part articulated parallelogram 12 having sides formed by portions of first structural member 21 and second structural member 22 along with third structural member 23 and fourth structural member 24. At a first corner of parallelogram 12, a distal end of first member 21 is pivotally attached to a proximate end of third member 23 by hinge assembly 25. At a second corner of parallelogram 12, hinge assembly 26 pivotally attaches first member 21 to second member 22, hinge 26 being a distance D from the distal end of first member 21 and a distance C from a proximate end of second member 22. Hinge assembly 27 attaches a distal end of second member 22 to a proximate end of fourth member 24 at a third corner of parallelogram 12 while, at a fourth corner, a distal end of member 24 is attached by hinge assembly 28 to third member 23. Signal light 10 is mounted on fourth member 24 with bracket 14.

Frame 20 also includes articulated lower quadrangle 16, being other than a parallelogram, and having two adjacent sides defined by first member 21 and second member 22 such that hinge 26 comprises a corner of lower quadrangle 16 as well as a corner of parallelogram 12. First member 21 is pivotally attached to base 30 by hinge assembly 31 while second member 22 is pivotally attached to a distal end of fifth structural member 42 by hinge assembly 32. Fifth member 42 is pivotally attached by hinge assembly 33 to base 30, hinges 26, 31, 32 and 33 thereby forming the articulated corners of lower quadrangle 16, with members 21, 22, and 42 forming three sides of quandrangle 16 and the fixed distance between hinge assemblies 31 and 33 forming the fourth side. The fourth side is preferably substantially horizontal and is non-parallel to, and longer than, the side between hinges 26 and 32.

Figure 2:
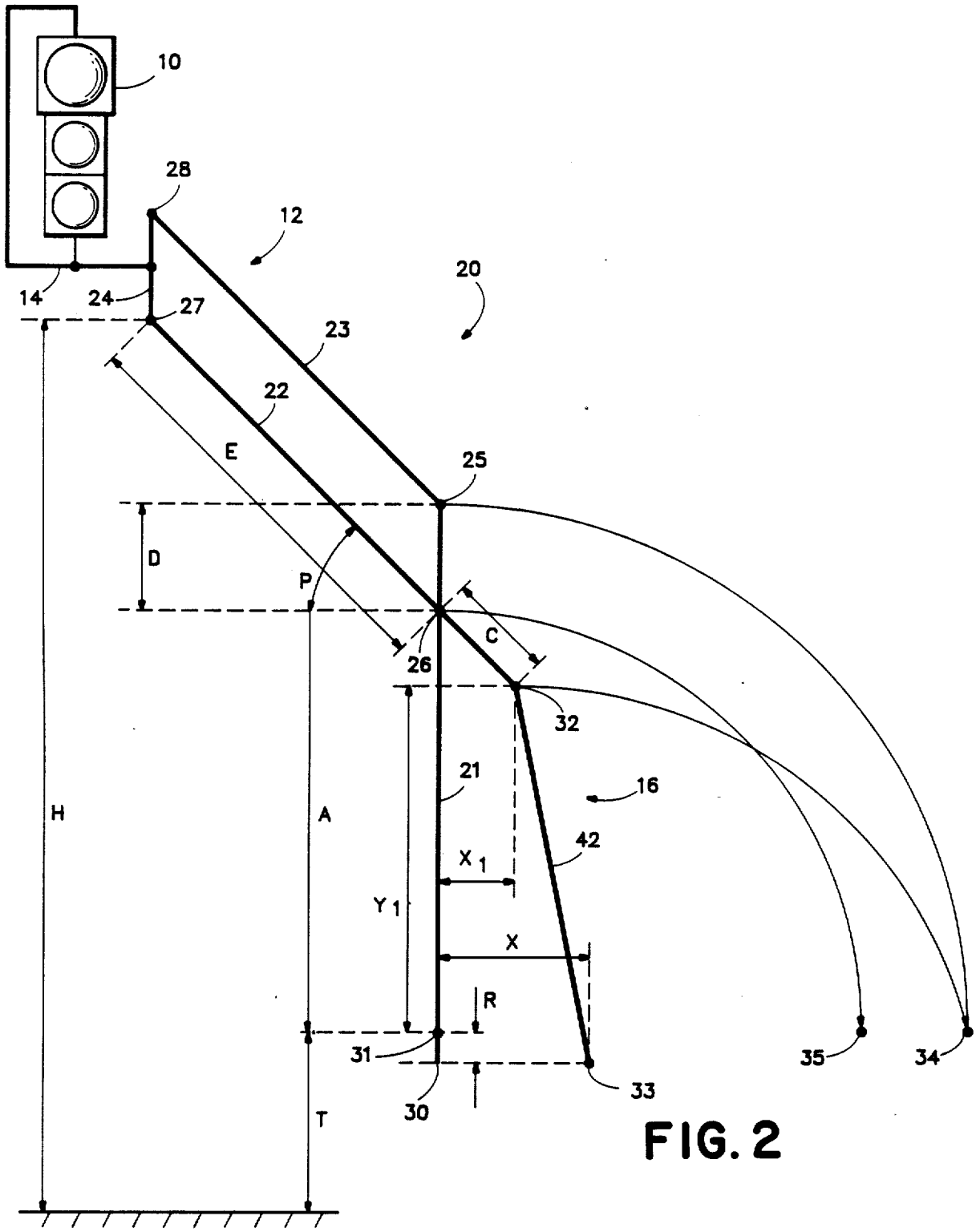
FIG. 2 is a an elevation view of the present invention similar to the view of FIG. 1 wherein structural members have been replaced with their line equivalents.

FIG. 2 is a simplified line drawing depicting an elevation view of frame 20 of the present invention wherein structural members are represented by line equivalents. Referring now to FIG. 2, frame 20 is fully extended by rotating first member 21 counter clockwise about hinge 31, its point of attachment to base 30, until first member 21 is in a vertical position as shown. When first member 21 is vertical, the point of attachment, hinge 32, of fifth member 42 to second member 22 is at a lower elevation than the point of attachment, hinge 26, of first member 21 to second member 22, thereby causing second member 22 and parallel third member 23 to be inclined from the horizontal by an acute angle P, and causing fourth member 24, being at all times parallel to first member 21, to rise above and horizontally extend beyond the truck or trailer bed.

Frame 20 is collapsed by rotating first member 21 clockwise about hinge 31 until first member 21 is horizontal. When frame 20 is in a fully collapsed position, hinge 25 in FIG. 2 translates to coincide with point 34 while hinge 26 translates to coincide with point 35. In the preferred embodiment the length C of second member 22 between hinges 26 and 32 is equal to length D of first member 21 between hinges 25 and 26 so that when frame 20 is fully collapsed, hinge 32 also generally coincides with point 34.

Figure 3:
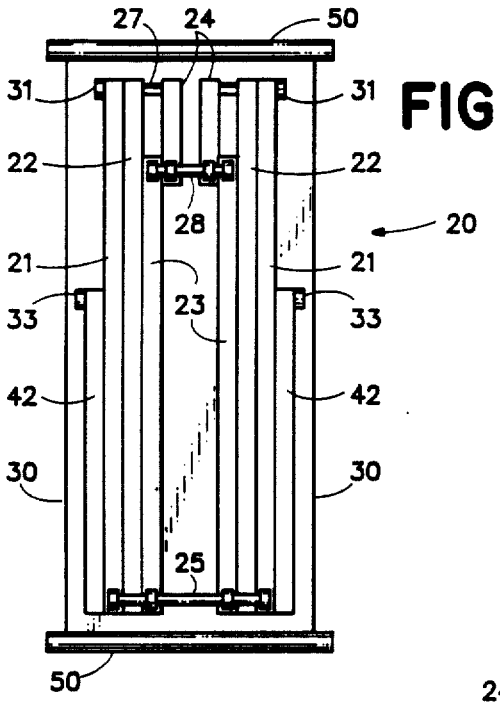
FIG. 3 is a plan view of the frame assembly of the present invention in fully contracted position.
Figure 4:
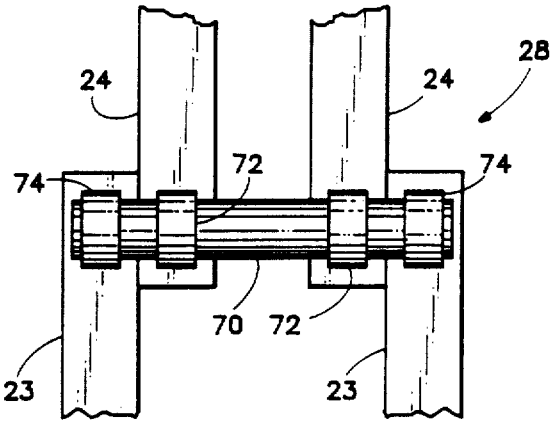
FIG. 4 is a plan view of a typical hinge assembly which may be used in the present invention.

Referring to FIG. 3 depicting a plan view of frame 20 when fully collapsed, frame 20 comprises two similar sets of first, second, third, fourth and fifth members 21, 22, 23, 24 and 42 (forming frame halves) respectively interconnected by sleeve and rod hinge assemblies 25 to 28 such that corresponding members move in unison when frame 20 is extended or collapsed. In FIG. 3, structural members 21 to 24 and 42 are offset such that when frame 20 is fully collapsed, members 24 and 23 nest within members 22, members 22 nest within members 21 and members 21 nest within members 42 thereby storing on bed 50 in a compact form. A typical interconnecting sleeve and rod hinge assembly 28 is depicted in FIG. 4 comprising sleeves 72 attached to fourth members 24, and sleeves 74 attached to third members 23, sleeves 72 and 74 being coupled for rotation about rod 70.

Figure 6:
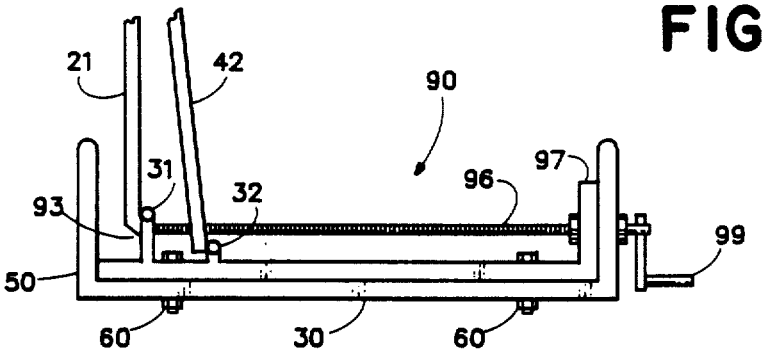
FIG. 6 is an elevation view of alternate means to extend and collapse the frame depicted in FIG. 1.

Referring again to FIG. 1, means 90 is provided to selectively extend and collapse frame 20 by rotating first member 21 about hinge 31, means 90 also rigidly fixing frame 20 when in the fully extended position, preventing it from collapsing. In the preferred embodiment means 90 comprises hydraulic jack 91 pivotally attached to bed 30 by hinge 92 with jack piston 94 coupled to first member 21 by hinge 93. First member 21 is rotated to the vertical position by retracting piston 94 and may be rotated to the horizontal position by extending piston 94. Jack 91 may be operated by a hand or motor powered, reversible hydraulic pump (not shown). Alternately, as depicted in FIG. 6, means 90 may comprise screw jack 96 coupled to base 30 by mounting post 97 and to first member 21 by hinge 93 pivotally attached to first member 21 and operated by rotating handle 99.

Figure 5:
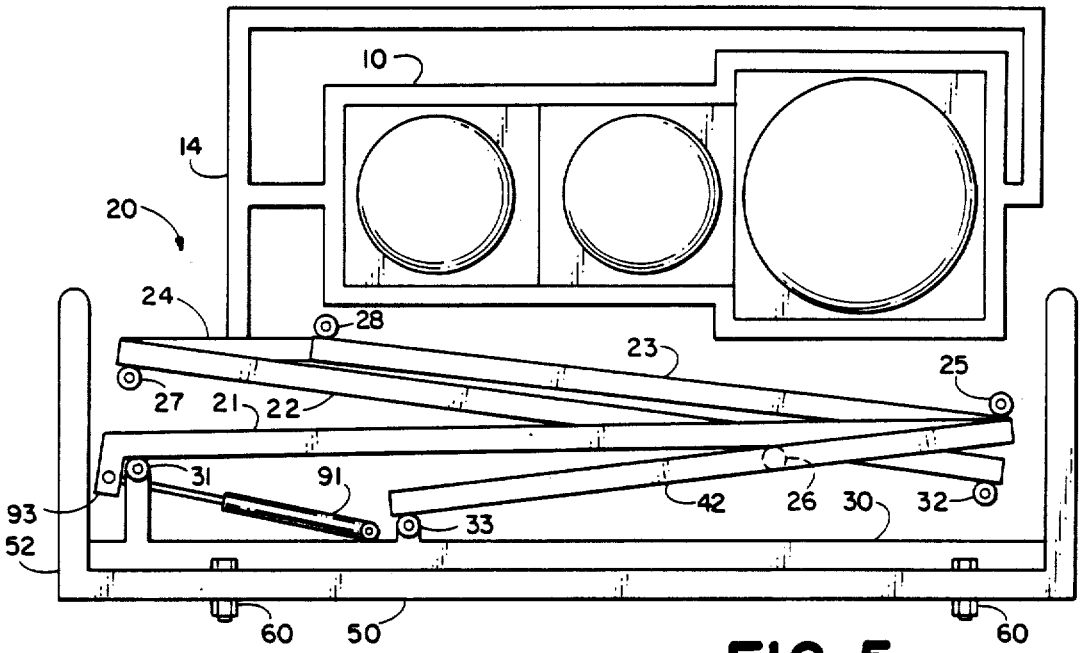
FIG. 5 is an elevation view of the present invention in nearly fully contracted position.

FIG. 5 depicts the portable traffic signal of present invention in nearly collapsed position on supporting vehicle bed 50. First member 21 of frame 20 is nearly horizontal having been rotated nearly ninety degrees about hinge 31 in the clockwise direction from the vertical position depicted in FIG. 1. Second member 22, third member 23 and fourth member 24 are also nearly horizontal. Signal light 10, attached to member 24 by bracket 14, has rotated nearly ninety degrees from its position shown in FIG. 1. When first member 21 rotates slightly more in the clockwise direction so that it is horizontal, members 22, 23 and 24 all align with member 21 in a common horizontal plane.

The present invention is particularly suited for use with a signal light 10 having a longer vertical dimension than horizontal dimension when in operating position so that the ninety degree rotation of signal light 10 occurring as a result of collapsing frame 20 allows the portable traffic signal to be stored on bed 50 with a more compact vertical dimension.

Referring again to FIG. 2, it is necessary that hinge assembly 33 attaching fifth member 42 to base 30 be located at a point equidistant from points 32 and 34. If hinge 33 occurs at any other point, members 21 through 24 will not collapse into parallel alignment when member 21 is rotated to the horizontal position and thus will not permit the portable traffic signal to be stored in as compact and secure manner as when members 21 through 24 are horizontally aligned. Preferably, to minimize the height of the traffic signal assembly when fully collapsed, fifth member 42 is attached to base 30 at a hinge 33 in such equidistant plane at an elevation equal to or near that of point 31. It should be noted that if first member 21 is vertically positioned and members 22 and 23 are inclined when frame 20 is fully extended, and if members 21, 22 and 23 are horizontally positioned when frame 20 is fully collapsed, quadrangle 16 cannot form a parallelogram.

In the preferred embodiment it is intended that when the traffic light assembly is mounted on the bed of a truck or trailer parked along the side of a roadway, with the signal light assembly fully extended, signal light 10 rises at least 8 feet above the level of the roadway surface and extends at least four feet from the centerline of the truck or trailer. Substantially identical frame 20a extends a second traffic light 10a in the opposite direction. If hinge assembly 31 mounted on bed 30 is a distance T above the roadway, if first member 21 is of length A between hinges 31 and 26, and if second member 22 is of length E between hinge assemblies 26 and 27, then the height H of hinge 27 above the roadway is found by the following expression where P is the angle of member 22 from horizontal:

$$H = T + A + E \sin(P)$$

In the preferred embodiment lengths A and E are both 35 inches. If height T is 36 inches, then according to the above expression, angle P must be approximately 45 degrees or larger to insure that hinge assembly 27, and therefore traffic light 10, is at least 8 feet above the roadway, the bottom of traffic light 10 being above hinge 27. With an angle P of 45 degrees, hinge assembly 27, and attached signal light 10, extend horizontally a distance equal to E cos(P) toward the roadway past point 31.

With length A of member 21 and length E of members 22 and 23 all 35 inches, and with lengths D and C associated with members 21 and 24 all 9 inches, then frame 20 will collapse into an approximately 44 inch wide assembly suitable for mounting on a 48 inch wide truck or trailer bed 30. With appropriate adjustments to the length and orientation of fifth member 42, it is not necessary for proper functioning of the present invention that length D equal length C or that length A equal length E. However equating such lengths permits maximum extension of the signal light in both vertical and horizontal directions for a given collapsed assembly maximum width.

Referring still to FIG. 2, the value of lengths A+C is first chosen to fit within the confines of an intended enclosure such as the bed of a pickup truck. After the value of A+C is chosen, C, A and angle P are chosen. The value of C must be much greater than the manufacturing error in the separation of hinge joints in order to minimize angular errors of the erected structure, and thus to minimize errors in the position and angle of the traffic signal. Small values of C also result in interference between structural members or in limitations in the values of angle P. On the other hand, large values of C reduce the permissible length of A and therefore reduce the height and horizontal extension of the traffic signal. Increasing angle P increases the height of the traffic signal but decreases the horizontal extension.

The distance R of hinge 31 above hinge 33 is chosen to be the minimum value which allows frame 20 to clear the edge of the intended enclosure, while the structure is being raised or lowered. Generally R will be small compared to A and may be reduced to zero in some applications.

After A, C, P and R are selected, the distances $X_1$ and $Y_1$, fixing the location of hinge 32 with respect to hinge 31 when frame 20 is fully extended, may be calculated as follows:

$$X_1 = C \cos(P)$$

$$Y_1 = A - C \sin(P)$$

The horizontal distance X of hinge 33 from hinge 31 and the length B of member 42 may then be calculated as follows:

$$X = [(A+C)^2 - X_1^2 - Y_1^2 - 2RY_1]/2[A+C-X_1]$$

$$B = [(A+C-X)^2 + R^2]^{\frac{1}{2}}$$

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A portable traffic signal comprising:

a base for mounting on a bed of a supporting vehicle, an articulated frame pivotally attached to the base and capable of extending and contracting, and traffic signaling means supported by the frame such that when the frame is extended, the signaling means is elevated and horizontally displaced from the base, and when the frame is fully contracted, the signaling means is lowered and positioned above the base, wherein the articulated frame comprises an articulated parallelogram having sides defined by a first, a second, a third and a fourth structural member, and an articulated quadrangle being other than a parallelogram having adjacent sides defined by the first and second structural members, and a third side defined by a fifth structural member, the first and fifth structural members having ends pivotally attached to the base, the quadrangle having a fourth side being defined by a line extending between the points of attachment to the base of the first and fifth structural members.

2. A portable traffic signal as in claim 1 wherein the traffic signaling means comprising a traffic light.

3. A portable traffic signal as in claim 1 wherein the first, second, third and fourth structural members are horizontally aligned when the articulated frame is fully contracted.

4. A portable traffic signal as in claim 1 wherein the traffic signaling means as attached to the fourth member.

5. A portable traffic signal as in claim 1 wherein said frame comprises two articulated frame halves attached to one another at points of articulation.

6. A portable traffic signal comprising:

a base for mounting on the bed of a supporting vehicle, first and second articulated frames pivotally attached to the base and capable of extending and contracting, first traffic signaling means supported by the first articulated frame such that when the frame is extended, the first signaling means is elevated and horizontally displaced from the base and when the frame is fully contracted, the first signaling means is lowered and positioned above the base, and second traffic signaling means supported by the second articulated frame such that when the frame is extended, the second signaling means is elevated and horizontally displaced from the base, and when the frame is fully contracted, the second signaling means is lowered and positioned above the base, wherein each articulated frame comprises an articulated parallelogram having sides defined by a first, a second, a third and a fourth structural member, and an articulated quadrangle being other than a parallelogram having adjacent sides defined by the first and second structural members, and a third side defined by a fifth structural member, the first and fifth structural members having ends pivotally attached to the base, said quadrangle having a fourth side being defined by a line extending between the points of attachment to the base of the first and fifth structural members.

7. A portable traffic signal as in claim 6 wherein the horizontal displacement of the first traffic signaling means from the base and the horizontal displacement of the second traffic signaling means from the base are in substantially opposite directions.

8. A portable traffic signal as in 6 wherein the first and second articulated frames are independently extended or contracted.

9. A portable traffic signal comprising:

a traffic light, a base, first means pivotally joined to said base and rotatable from a substantially horizontal position toward a substantially upright position, a parallelogram linkage including a portion of said first means spaced along said first means from said base, a support means parallel to said first means for supporting said traffic light, and parallel side members respectively pivotally connected to said first and support means for completing said parallelogram linkage, and an inextensible second means pivotally joined to said base and pivotally connected to a said side member of said parallelogram linkage for constraining said parallelogram linkage to raise said traffic light vertically and move it horizontally with respect to said base as said first means rotates toward an upright position while said support means rotates with said first means for changing the orientation of said traffic light from a substantially horizontal attitude to a substantially vertical attitude.

10. The traffic signal according to claim 9 wherein said second means is pivotally connected to a said side member at a first distance from where said side member is pivotally connected to said first member, and wherein said second means is pivotally joined to said base at a distance from where said first means is pivotally joined to said base which is larger than said first distance.

11. A portable traffic signal comprising:

a traffic light, a base, and an articulated frame comprising a first, a second, a third, a fourth and a fifth structural member and a first, a second, a third, a fourth, a fifth, a sixth and a seventh pivot, wherein the first pivot joins the proximal end of the first member to the base, the second pivot joins a non-terminal point on the first member to a non-terminal point on the second member, the third pivot joins the distal end of the first member to the proximal end of the third member, the fourth pivot joins the proximal end of the second member to the distal end of the fifth member, the fifth pivot joins the proximal end of the fifth member to the base, the sixth pivot joins the proximal end of the fourth member to the distal end of the second member, the seventh pivot joins the distal end of the fourth member to the distal end of the third member, and wherein the traffic light is mounted on the fourth member.

12. A portable traffic signal as in claim 11 wherein the length of that portion of the first member between the second pivot and the third pivot is equal to the length of the fourth member, and the length of that portion of the second member between the second pivot and the sixth pivot is equal to the length of the third member, thereby forming a parallelogram, and wherein the length of that portion of the second member between the second pivot and the fourth pivot is substantially different from the length of a line between the first pivot and the fifth pivot, thus forming a quandrangle other than a parallelogram.

* * * * *

UNITED STATES PATENT AND TRADEMARK OFFICE

CERTIFICATE OF CORRECTION

PATENT NO. : 4,706,087

DATED : November 10, 1987

INVENTOR(S) : Melvin A. Holznagel

It is certified that error appears in the above-identified patent and that said Letters Patent is hereby corrected as shown below:

Column 1, line 8, "employed maintain" should be --employed to maintain--.

Column 6, line 48, "comprising" should be --comprises--.

Column 6, line 54, "as" should be --is--.

Signed and Sealed this

Sixth Day of August, 1991

*Attest:*

HARRY F. MANBECK, JR.

*Attesting Officer*

*Commissioner of Patents and Trademarks*